US007416273B2

(12) United States Patent
Kusunoki

(10) Patent No.: US 7,416,273 B2
(45) Date of Patent: Aug. 26, 2008

(54) LIQUID EJECTION HEAD AND IMAGE FORMING APPARATUS INCLUDING LIQUID EJECTION HEAD

(75) Inventor: Naoki Kusunoki, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/709,229

(22) Filed: Feb. 22, 2007

(65) Prior Publication Data

US 2007/0195126 A1 Aug. 23, 2007

(30) Foreign Application Priority Data

Feb. 23, 2006 (JP) ..... 2006-046408

(51) Int. Cl.
*B41J 2/145* (2006.01)
*B41J 2/15* (2006.01)

(52) U.S. Cl. ..... 347/40

(58) Field of Classification Search ..... 375/40, 375/65

See application file for complete search history.

(56) References Cited

U.S. PATENT DOCUMENTS 6,447,088 B2 * 9/2002 Tachihara et al. ..... 347/15
6,789,877 B2 * 9/2004 Murakami et al. ..... 347/40
2001/0043243 A1 11/2001 Tachihara et al.

FOREIGN PATENT DOCUMENTS

JP 9-254413 A 9/1997

* cited by examiner

*Primary Examiner*—Thinh H Nguyen
(74) *Attorney, Agent, or Firm*—Birch, Stewart, Kolasch & Birch, LLP

(57) ABSTRACT

The liquid ejection head includes: a large nozzle which ejects a large droplet of liquid; a small nozzle which has a smaller nozzle diameter than the large nozzle and ejects a small droplet of the liquid which has a smaller volume than the large droplet; a first heat generating element and a second heat generating element which are provided opposite to the large nozzle and the small nozzle respectively, and apply thermal energy to the liquid in at least one individual flow channel that supplies the liquid to the large nozzle and the small nozzle in such a manner that a bubble causing the large droplet of the liquid to be ejected from the large nozzle and a bubble causing the small droplet of the liquid to be ejected from the small nozzle respectively; a first liquid chamber which is provided between the large nozzle and the at least one individual flow channel and between the large nozzle and the first heat generating element corresponding to the large nozzle.

5 Claims, 11 Drawing Sheets

LIQUID EJECTION HEAD AND IMAGE FORMING APPARATUS INCLUDING LIQUID EJECTION HEAD

BACKGROUND OF THE INVENTION

1. Field of the Invention

The present invention relates to a liquid ejection head and an image forming apparatus comprising a liquid ejection head, and more particularly, to the stabilization of ink in a liquid ejection head capable of forming high-definition images.

2. Description of the Related Art

As an image forming apparatus in the related art, an inkjet printer (inkjet recording apparatus) is known, which includes an inkjet printer head (liquid ejection head) having an arrangement of a plurality of liquid ejection nozzles and which records images on a recording medium by ejecting ink (liquid) from the nozzles toward the recording medium while the relative movement between the inkjet head and the recording medium is performed.

The inkjet head of the inkjet printer ejects ink, for example, either by using piezoelectric elements or by generating bubbles by means of heating elements.

For example, in an inkjet head which ejects ink by generating bubbles by means of heating elements, the inkjet head generates bubbles by applying energy to heaters and causes ink droplets to be ejected by the pressure created by the bubbles, thereby recording images onto a recording medium. One of characteristics of such heads is their silent operation.

In an inkjet head of this kind, graduated tone recording is carried out in order to achieve high definition. More specifically, graduated tone recording is carried out by controlling the ejection volume of the ink. In this case, in a system based on heating elements in particular, it is difficult to achieve sufficient control of recording by means of nozzles having one and the same structure (a common structure). For example, when the ejection speed is adjusted on the basis of large liquid droplets in order for the large liquid droplets to be ejected at an appropriate speed, the actual ejection speed of small liquid droplets becomes slow and the ejection direction of small liquid droplets becomes unstable. Thus, it is difficult to obtain stable images. On the other hand, when the ejection speed is adjusted on the basis of small liquid droplets in order for the small liquid droplets to be ejected at an appropriate speed, the actual ejection speed of large liquid droplets becomes markedly high and rebounding of the droplets may occur when they deposit onto a recording medium. Thus, soiling of the image is caused.

Japanese Patent Application Publication No. 9-254413 discloses a method in which nozzles for ejecting large liquid droplets and nozzles for ejecting small liquid droplets are provided, and high-definition images are obtained by combining the liquid droplets ejected from these nozzles. More specifically, the nozzle diameters and heater sizes, and the like, of the nozzles for large liquid droplets differ from those of the nozzles for small liquid droplets. Based on such structure, the liquid droplets are ejected under optimal ejection conditions, in accordance with the size of the liquid droplets. Thus, a high-definition image can be obtained stably.

However, if a nozzle for ejecting large liquid droplets and a nozzle for ejecting small liquid droplets are provided as described in Japanese Patent Application Publication No. 9-254413, then new possibilities arise because of the difference between the usage frequencies of the nozzles.

More specifically, in cases where graduated tone recording for an image is carried out on the basis of area tones, small liquid droplets are principally used in order to raise tonal expressiveness. A large number of small liquid droplets are used especially in a region where there is marked change in the color tones of the image. On the other hand, large liquid droplets are principally used in a region where the color tones of the image are dark and where there is virtually no change in the color tones, namely, in a region having a large surface area of a single dark color, from viewpoints of reducing the number of ejection operations and the power consumption, and raising the printing speed.

In the cases where the nozzles for ejecting large liquid droplets and the nozzles for ejecting small liquid droplets are thus used selectively, the nozzles for ejecting large liquid droplets are used only for a region where the color tones of the image are dark and where there is little change in the color tones, namely, a region having a large surface area of a single dark color. Therefore, in the case of general high-definition images, the usage frequency of the nozzles for ejecting small liquid droplets tends to be higher than that of the nozzles for ejecting large liquid droplets. If ink inside the nozzles is not used for a long period of time, then the solvent contained in the ink evaporates and the viscosity of the ink increases. Since usage frequency of nozzles for ejecting large liquid droplets is thus different from usage frequency of the nozzles for ejecting small liquid droplets, then the viscosity of the ink in the vicinity of the nozzles having a low usage frequency, namely, the nozzles for ejecting large liquid droplets, becomes greater than the viscosity of the ink in the vicinity of the nozzles for ejecting small liquid droplets.

This situation is described more specifically with reference to FIG. 11. FIG. 11 is a cross-sectional diagram showing a liquid ejection head which generates bubbles by means of heat generated from heating elements (heaters) and thereby ejects ink from nozzles for ejecting small liquid droplets and nozzles for ejecting large liquid droplets.

A nozzle (small nozzle) 91 for ejecting small liquid droplets and a nozzle (large nozzle) 92 for ejecting large liquid droplets are provided in a nozzle plate 90, and heaters 95 and 96 corresponding to the nozzles 91 and 92 (small nozzle and large nozzle) are provided across an ink flow channel 93 from the nozzles 91 and 92, respectively. Usage frequency of the small nozzle 91 is high during the operation of the image formation apparatus, and ink flows constantly into the small nozzle 91 from the ink flow channel 93. Therefore, the viscosity of the ink inside the nozzle 91 for ejecting small liquid droplets does not increase. On the other hand, usage frequency of the large nozzle 92 is not high, and therefore ink which has flowed in from the ink flow channel 93 and which fills the large nozzle 92 remains in the nozzle 92 for a long period of time. Therefore, the viscosity of ink in the vicinity of the large nozzle 92 increases gradually and the increased viscosity region 94 of the ink extends progressively from the large nozzle 92 and the vicinity thereof, to the ink flow channel 93, as indicated by the arrows in FIG. 11.

In cases where viscosity of the ink inside the nozzles has increased, it is necessary to carry out a suctioning operation as described below. If the increased viscosity region 94 of the ink has extended into the ink flow channel 93 from the large nozzle 92, then it is necessary to suction a large amount of ink in order to remove the ink in the increased viscosity region 94, and hence a large amount of ink is wasted.

Furthermore, the suctioning operation is carried out by means of a common suctioning cap, at the same suctioning pressure for both the large nozzle 92 and the small nozzle 91. There is a difference in the aperture diameter between the large nozzle 92 and the small nozzle 91, and the flow resistance in the large nozzle 92 is lower than that in the small nozzle 91. Therefore, the amount of ink suctioned from the large nozzle 92 is large and wasteful consumption of ink occurs.

SUMMARY OF THE INVENTION

The present invention has been contrived in view of foregoing circumstances, an object thereof being to provide a liquid ejection head having a nozzle (large nozzle) for ejecting a large liquid droplet and a nozzle (small nozzle) for ejecting a small liquid droplet, whereby wasteful consumption of ink is avoided as far as possible when ink of increased viscosity is suctioned.

In order to attain the aforementioned object, the present invention is directed to a liquid ejection head, comprising: a large nozzle which ejects a large droplet of liquid; a small nozzle which has a smaller nozzle diameter than the large nozzle and ejects a small droplet of the liquid which has a smaller volume than the large droplet; a first heat generating element and a second heat generating element which are provided opposite to the large nozzle and the small nozzle respectively, and apply thermal energy to the liquid in at least one individual flow channel that supplies the liquid to the large nozzle and the small nozzle in such a manner that a bubble causing the large droplet of the liquid to be ejected from the large nozzle and a bubble causing the small droplet of the liquid to be ejected from the small nozzle respectively; a first liquid chamber which is provided between the large nozzle and the at least one individual flow channel and between the large nozzle and the first heat generating element corresponding to the large nozzle.

In this aspect of the invention, it is possible to reduce wasteful consumption of the liquid (e.g., ink) in suctioning operation. A single channel or a plurality of channels can form the individual flow channel(s); for example, the individual flow channels may be a common channel, or may be different channels. The above-mentioned liquid includes ink, for example.

Preferably, the liquid ejection head further comprises a second liquid chamber which is provided between the small nozzle and the second heat generating element corresponding to the small nozzle.

In this aspect of the invention, by forming the large nozzle and the small nozzle to have substantially similar peripheral shapes, it is possible to make the in-flight shape of the large droplet and the in-flight shape of the small droplet become similar, and therefore a desired image can be obtained effectively.

Preferably, the large nozzle and the small nozzle are provided for the one individual flow channel.

Preferably, the small nozzle is nearer to a common flow channel than the large nozzle, the common flow channel supplying the liquid to the one individual flow channel.

In order to attain the aforementioned object, the present invention is also directed to an image forming apparatus comprising any one of the liquid ejection heads described above.

In this aspect of the present invention, the running costs can be reduced, and the frequency of maintenance, such as liquid (ink) replacement, can be reduced.

According to the present invention, in a liquid ejection head having a nozzle (large nozzle) which ejects a large liquid droplet and a nozzle (small nozzle) which ejects a small liquid droplet, it is possible to maintain a good balance between the suction volume of the large nozzle and the suction volume of the small nozzle when liquid (e.g., ink) of increased viscosity is suctioned. Hence, it is possible to reduce wasteful consumption of liquid. Furthermore, the running costs of the image forming apparatus including such a liquid ejection head can be reduced, and the frequency of maintenance tasks, such as replacing a liquid cartridge, can be reduced.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
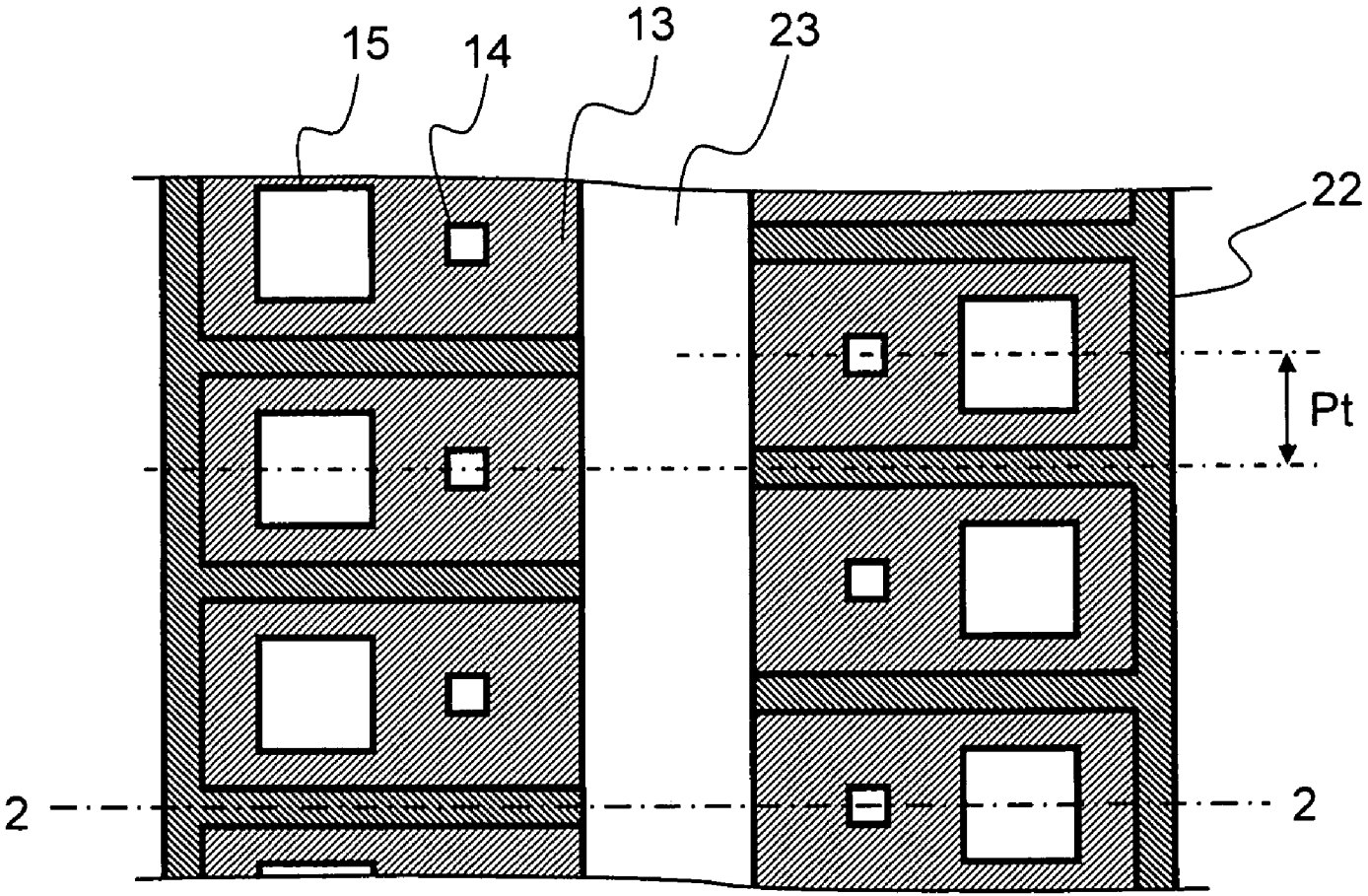
FIG. 1 is a plan perspective diagram of a liquid ejection head according to a first embodiment of the present invention, a nozzle plate being removed.
Figure 2:
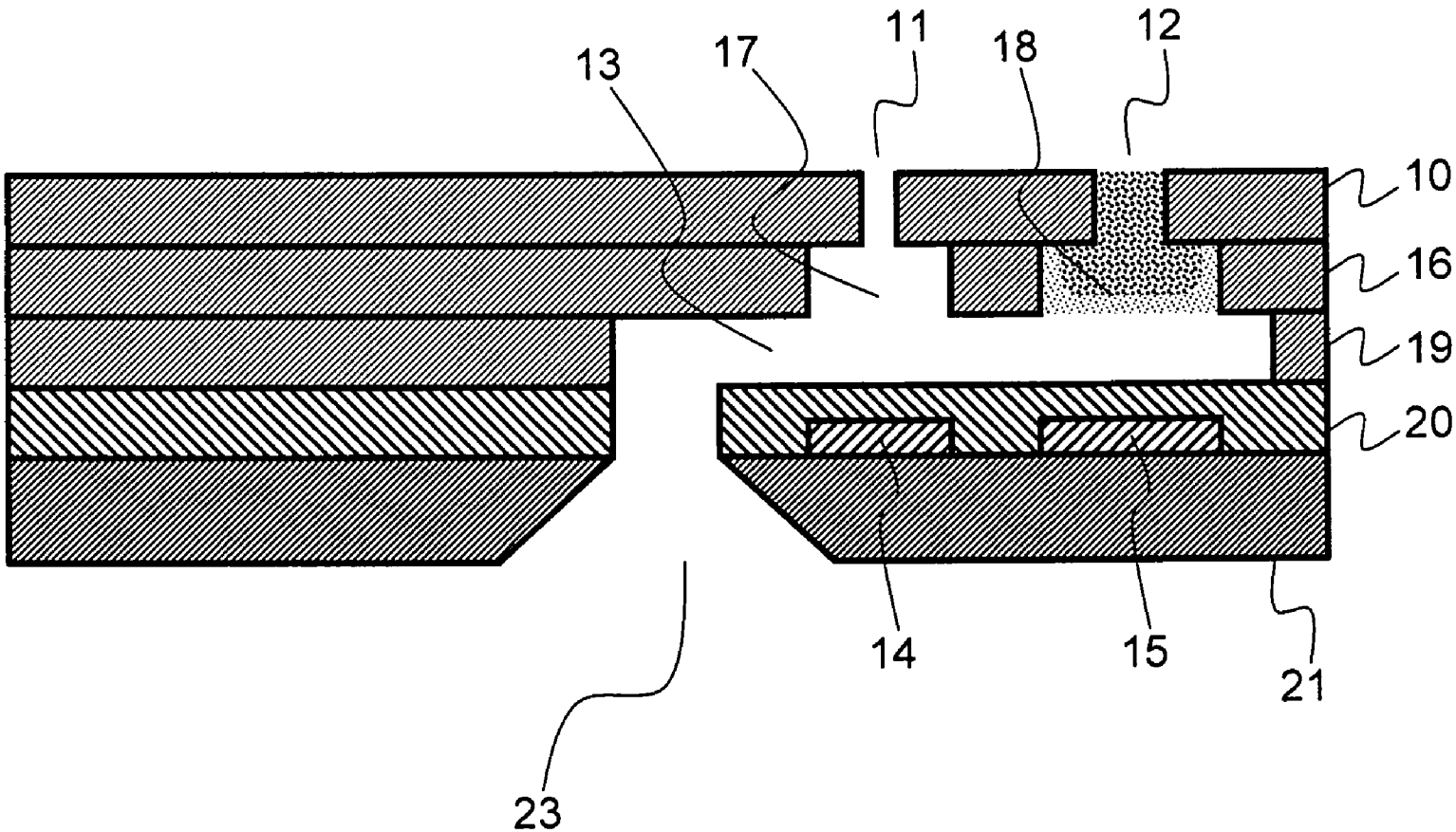
FIG. 2 is a cross-sectional diagram of the liquid ejection head according to the first embodiment of the present invention.

FIG. 1 is a plan perspective diagram of a liquid ejection head according to a first embodiment of the present invention, in a state where a nozzle plate is removed. FIG. 2 is a cross-sectional diagram of a liquid ejection head according to the first embodiment of the present invention (a cross-sectional diagram of the liquid ejection head along line 2-2 in FIG. 1).

As shown in FIG. 2, in the liquid ejection head according to the first embodiment, nozzles (small nozzles) 11 for ejecting small liquid droplets and nozzles (large nozzles) 12 for ejecting large liquid droplets are provided in the nozzle plate 10. The ink flow channels includes individual flow channels 13 and a common flow channel 23. A heater 14 corresponding to each small nozzle 11 and a heater 15 corresponding to each large nozzle 12 are provided on the substrate 21 so as to be arranged across the individual flow channel 13 (which is a part of the ink flow channels) from the respective nozzles. A protective layer 20 covers the heaters 14 and 15. A large nozzle liquid chamber 18 which serves as an ink chamber is provided between each large nozzle 12 and the heater 15 corresponding to the large nozzle 12, and an individual flow channel 13 is provided between the large nozzle liquid chamber 18 and the heater 15 so as to be arranged in a position adjacent to the large nozzle liquid chamber 18. Similarly, a small nozzle liquid chamber 17 which serves as an ink chamber is provided between each small nozzle 11 and the heater 14 corresponding to the small nozzle 11, and the individual flow channel 13 is provided between the small nozzle liquid chamber 17 and the heater 14 so as to be arranged in a position adjacent to the small nozzle liquid chamber 17. Each large nozzle liquid chamber 18 and each small nozzle liquid chamber 17 are formed by providing grooves, or the like, in the nozzle liquid chamber plate 16. Each large nozzle liquid chamber 18 is formed so as to have a greater volume than the volume of each small nozzle liquid chamber 17. Each individual flow channel 13 is constituted by the individual flow channel plate 19, and it is connected to the common flow channel 23 which serves as a part of the ink flow channels. Ink is supplied from an ink tank (not illustrated) to each individual flow channel 13. As shown in FIG. 1, the individual flow channels 13 are divided by a partition wall 22 formed by the individual flow channel plate 19, and moreover the whole of the liquid ejection head is surrounded by the partition wall 22 of the individual flow channel plate 19. A heater 14 corresponding to one small nozzle 11 and a heater 15 corresponding to one large nozzle 12 are provided for each individual flow channel 13.

In the liquid ejection head according to the present embodiment of the invention, ink is supplied from the common flow channel 23 to the individual flow channels 13 and the ink supplied to the individual flow channels 13 is ejected from the small nozzles 11 and the large nozzles 12 in accordance with information from the under-mentioned control system of the image forming apparatus.

Since the usage frequency of each large nozzle 12 is low, then increase in the viscosity of the ink starts from the ink of each large nozzle 12. However, the large nozzle liquid chambers 18 are provided, and hence the viscosity increase region of the ink hardly extends into the individual flow channels 13 until it extends all over the large nozzle liquid chambers 18.

It is necessary to carry out the suctioning operation described below when the viscosity of ink has increased. When the suctioning operation is carried out to remove the ink of increased viscosity, it is sufficient to suction the ink accumulated in the large nozzles 12 and the large nozzle liquid chambers 18, and suctioning of the ink inside the individual flow channels 13 is not necessary. Consequently, the consumption of ink in the suctioning operation is reduced in comparison with the related art.

Suctioning is carried out when the viscosity of ink has increased. Since the large nozzles 12 generally have a lower usage frequency as described above, then the viscosity of the ink inside the large nozzles 12 is liable to increase to a greater extent than that of the ink in the small nozzles 11. Since the large nozzles 12 have a large nozzle diameter and occupy a greater volume than the small nozzle liquid chambers 17, then the geometrical flow channel resistance of the large nozzles 12 is lower than that of the small nozzles 11. Thus, in the large nozzles 12, the increase in the ink viscosity causes the ink flow resistance to rise, whereas the geometrical flow resistance is low. On the other hand, in the small nozzles 11, the increase of the ink flow resistance caused by increase in the ink viscosity is low, whereas the geometrical flow channel resistance is high. Consequently, in the suctioning operation, ink is not excessively suctioned from only either one of the nozzles 11 and 12, and the suctioning operation is carried out with respect to both of the large nozzle 12 and the small nozzle 11 in a well balanced fashion. Moreover, since the ink of increased viscosity of the large nozzles is present inside the large nozzle liquid chambers 18, the overall consumption of the ink in the suctioning operation is reduced. Since the small nozzles 11 have a high usage frequency and little tendency to suffer increase in viscosity, then it is not absolutely necessary to provide the small nozzle liquid chambers 17. In cases where the small nozzle liquid chambers 17 are provided and the large nozzles and the small nozzles are made to have substantially similar peripheral shapes, in-flight shapes of the liquid droplets (including satellites) can be controlled in such a manner that the in-flight shape of droplets ejected from the large nozzles is similar to the in-flight shape of droplets ejected from the small nozzles.

EXAMPLE

Below, an example of the liquid ejection head according to the present embodiment is described with reference to FIGS. 1 and 2.

In the liquid ejection head of the present example, the small nozzles 11 have a nozzle diameter of 20.3 μm, the large nozzle 12 have a nozzle diameter of 28.2 μm. The heaters 14 opposing the small nozzles 11 have a substantially square shape having an edge length of 23 μm, and the heaters 15 opposing the large nozzles 12 have a substantially square shape having an edge length of 31 μm.

The length of the small nozzles 11, the length of the large nozzles 12, and the thickness of the nozzle plate 10 are 7 μm. The height of the small nozzle liquid chambers 17, the height of the large nozzle liquid chambers 18, and the thickness of the nozzle liquid chamber plate 16 are 5 μm. The height of the individual flow channels 13 and the thickness of the individual flow channel plate 19 are 8 μm.

The nozzle pitch Pt shown in FIG. 1 is 84.6 μm, and this nozzle pitch corresponds to 300 dpi (dots per inch).

Figure 3:
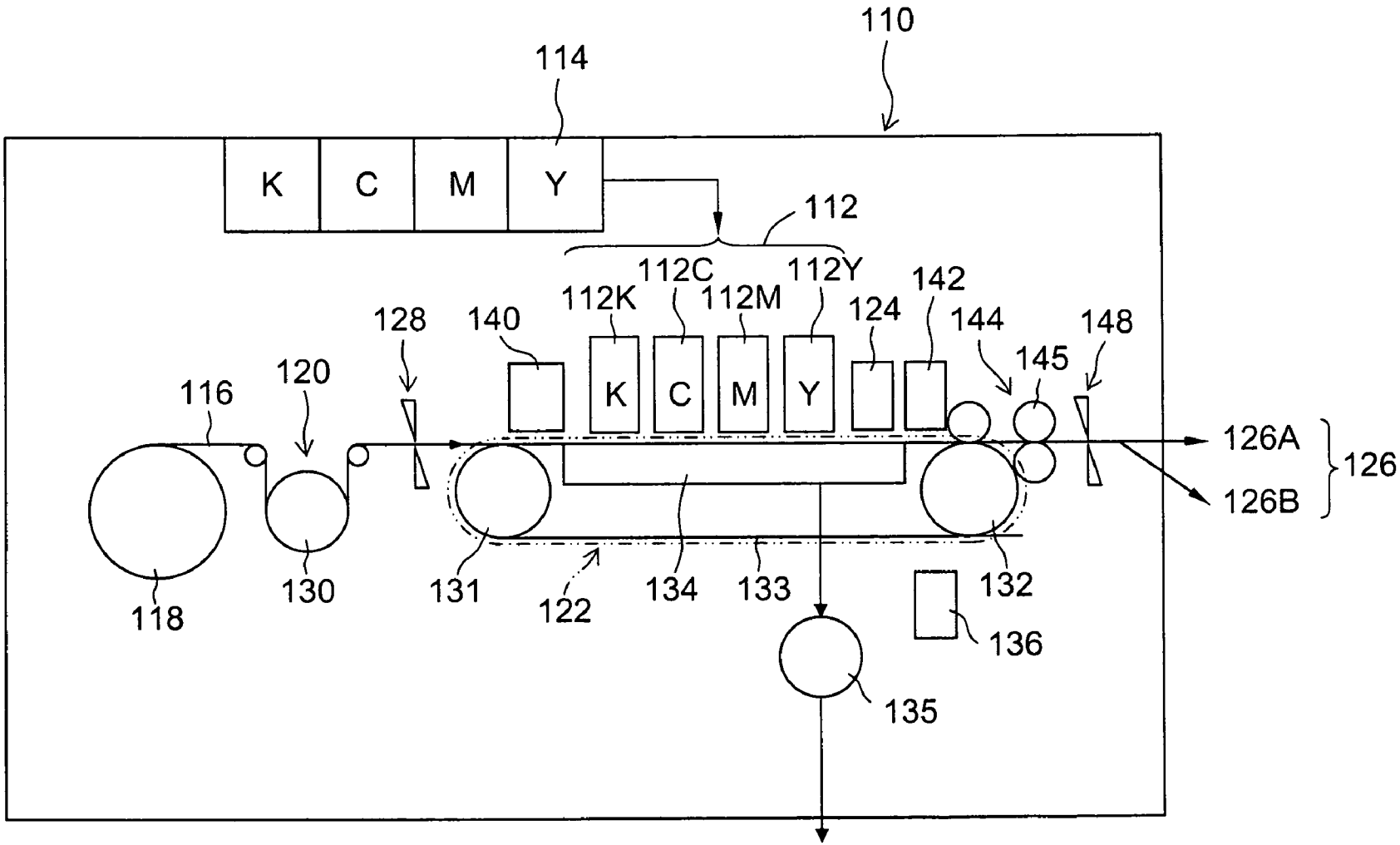
FIG. 3 is a general compositional drawing of an inkjet recording apparatus forming an image forming apparatus according to an embodiment of the present invention.

FIG. 3 is a general compositional drawing showing an approximate view of an image forming apparatus including an inkjet head (liquid ejection head) according to an embodiment of the present invention.

As shown in FIG. 3, the inkjet recording apparatus 110 comprises: a printing unit 112 having a plurality of print heads (liquid ejection heads) 112K, 112C, 112M, and 112Y for ink colors of black (K), cyan (C), magenta (M), and yellow (Y), respectively; an ink storing and loading unit 114 for storing inks of K, C, M and Y to be supplied to the print heads 112K, 112C, 112M, and 112Y; a paper supply unit 118 for supplying recording paper 116; a decurling unit 120 for removing curl in the recording paper 116; a belt conveyance unit 122 disposed facing the nozzle face (ink-droplet ejection face) of the print unit 112, for conveying the recording paper 116 while keeping the recording paper 116 flat; a print determination unit 124 for reading the printed result produced by the printing unit 112; and a paper output unit 126 for outputting image-printed recording paper (printed matter) to the exterior.

Each of the print heads (liquid ejection heads) 112K, 112C, 112M, and 112Y has small nozzles 11 and large nozzles 12 as shown in FIGS. 1 and 2.

In FIG. 3, a magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 128 is provided as shown in FIG. 3, and the roll paper is cut to a desired size by the cutter 128. The cutter 128 has a stationary blade having a length equal to or greater than the width of the conveyance path of the recording paper 116, and a round blade which moves along the stationary blade. The stationary blade is disposed on the reverse side of the printed surface of the recording paper, and the round blade is disposed on the side adjacent to the printed surface across the conveyance path. When cut paper is used, the cutter 128 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording paper to be used is automatically determined, and ink droplet ejection is controlled so that the ink droplets are ejected in an appropriate manner in accordance with the type of paper.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

The decurled and cut recording paper 116 is delivered to the belt conveyance unit 122. The belt conveyance unit 122 has a configuration in which an endless belt 133 is set around rollers 131 and 132 so that the portion of the endless belt 133 facing at least the nozzle face of the printing unit 112 and the sensor face of the print determination unit 124 forms a plane (flat plane).

There are no particular limitations on the structure of the belt conveyance unit 122, and it may use vacuum suction conveyance in which the recording paper 116 is conveyed by being suctioned onto the belt 133 by negative pressure created by suctioning air through suction holes provided on the belt surface, or it may be based on electrostatic attraction.

The belt 133 has a width dimension that is broader than the width of the recording paper 116, and in the case of the vacuum suction conveyance method described above, a plurality of suction holes (not illustrated) are formed in the surface of the belt. A suction chamber 134 is disposed in a position facing the sensor surface of the print determination unit 124 and the nozzle surface of the printing unit 112 on the interior side of the belt 133, which is set around the rollers 131 and 132, as shown in FIG. 3; and this suction chamber 134 provides suction with a fan 135 to generate a negative pressure, thereby holding the recording paper 116 onto the belt 133 by suction.

The belt 133 is driven in the clockwise direction in FIG. 3 by the motive force of a motor (not shown in drawings) being transmitted to at least one of the rollers 131 and 132, which the belt 133 is set around, and the recording paper 116 held on the belt 133 is conveyed from left to right in FIG. 3.

Since ink adheres to the belt 133 when a marginless print job or the like is performed, a belt-cleaning unit 136 is disposed in a predetermined position (a suitable position outside the printing area) on the exterior side of the belt 133. Although the details of the configuration of the belt-cleaning unit 136 are not shown, embodiments thereof include a configuration of nipping cleaning rollers such as a brush roller and a water absorbent roller, an air blow configuration in which clean air is blown, or a combination of these. In the case of the configuration of nipping the cleaning rollers, it is preferable to make the line velocity of the cleaning rollers different than that of the belt 133 to improve the cleaning effect.

The inkjet recording apparatus 110 can include a roller nip conveyance mechanism, in which the recording paper 116 is pinched and conveyed with nip rollers, instead of the belt conveyance unit 122. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 140 is disposed on the upstream side of the printing unit 112 in the conveyance pathway formed by the belt conveyance unit 122. The heating fan 140 blows heated air onto the recording paper 116 to heat the recording paper 116 immediately before printing so that the ink deposited on the recording paper 116 dries more easily.

Figure 4:
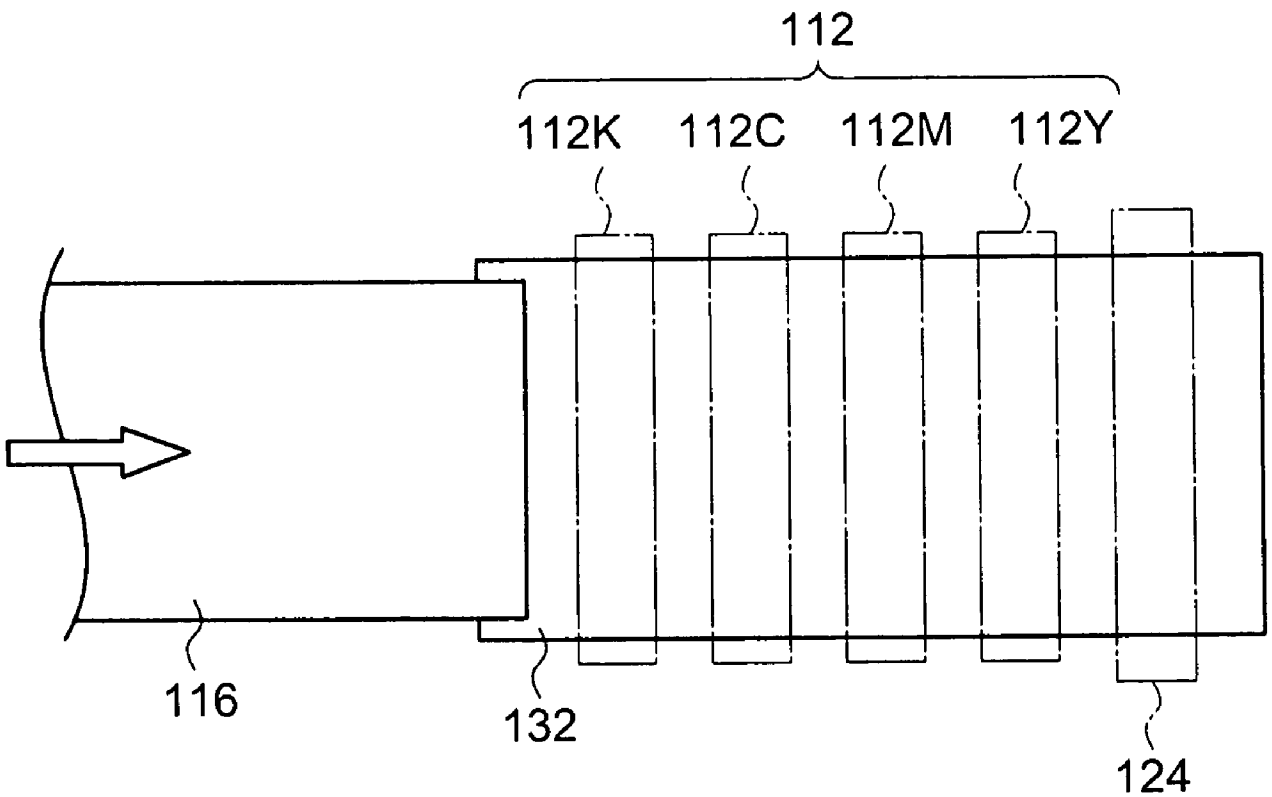
FIG. 4 is a principal plan diagram of the peripheral part of a print unit of an inkjet recording apparatus forming an image forming apparatus according to an embodiment of the present invention.

FIG. 4 is a principal plan diagram showing the periphery of the print unit 112 in the inkjet recording apparatus 110.

As shown in FIG. 4, the print unit 112 is a so-called "full line head" in which a line head having a length corresponding to the maximum paper width is arranged in a direction (main scanning direction) that is perpendicular to the paper conveyance direction (sub-scanning direction).

The print heads 112K, 112C, 112M, and 112Y are constituted by line heads in which a plurality of ink ejection ports (nozzles) are arranged through a length exceeding at least one side of the maximum size recording paper 116 intended for use with the inkjet recording apparatus 110.

The print heads 112K, 112C, 112M, 112Y corresponding to respective ink colors are disposed in the order, black (K), cyan (C), magenta (M) and yellow (Y), from the upstream side (left-hand side in FIG. 4), following the direction of conveyance of the recording paper 116 (the paper conveyance direction). A color print can be formed on the recording paper 116 by ejecting the inks from the print heads 112K, 112C, 112M, and 112Y, respectively, onto the recording paper 116 while conveying the recording paper 116.

The print unit 112, in which the full-line heads covering the entire width of the paper are thus provided for the respective ink colors, can record an image over the entire surface of the recording paper 116 by performing the action of the relative movement between the recording paper 116 and the print unit 112 in the paper conveyance direction (sub-scanning direction) just once (in other words, by means of a single sub-scan). Higher-speed printing is thereby made possible and productivity can be improved in comparison with a shuttle type head configuration in which a print head moves reciprocally in a direction (main scanning direction) that is perpendicular to the paper conveyance direction.

Here, the terms main scanning direction and sub-scanning direction are used in the following senses. In a full-line head including nozzle rows that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning action, while moving the full-line head and the recording paper relatively to each other. The direction in which sub-scanning is performed is called the sub-scanning direction. Consequently, the conveyance direction of the recording paper is the sub-scanning direction and the direction perpendicular to same is called the main scanning direction.

Although a configuration with four standard colors, K M C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 3, the ink storing and loading unit 114 has ink tanks for storing the inks of the colors corresponding to the respective print heads 112K, 112C, 112M, and 112Y, and the respective tanks are connected to the print heads 112K, 112C, 112M, and 112Y by means of channels (not shown). The ink storing and loading unit 114 has a warning device (for example, a display device, an alarm sound generator or the like) for warning when the remaining amount of any ink is low, and has a mechanism for preventing loading errors among the colors.

The print determination unit 124 has an image sensor (line sensor) for capturing an image of the ink-droplet deposition result of the printing unit 112, and functions as a device to check for ejection defects such as clogs of the nozzles from the ink-droplet deposition results evaluated by the image sensor.

The print determination unit 124 of the present embodiment is configured with at least a line sensor having rows of photoelectric transducing elements with a width that is greater than the ink-droplet ejection width (image recording width) of the print heads 112K, 112C, 112M, and 112Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 124 reads a test pattern image printed by the print heads 112K, 112C, 112M, and 112Y for the respective colors, and the ejection of each head is determined. The ejection determination includes the presence of the ejection, measurement of the dot size, and measurement of the dot deposition position.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming into contact with ozone and other substance that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. The cutter 148 is disposed directly in front of the paper output unit 126, and is used for cutting the test print portion from the target print portion when a test print has been performed in the blank portion of the target print. The structure of the cutter 148 is the same as the first cutter 128 described above, and has a stationary blade and a round blade.

Although not shown in drawings, the paper output unit 126A for the target prints is provided with a sorter for collecting prints according to print orders.

Figure 5:
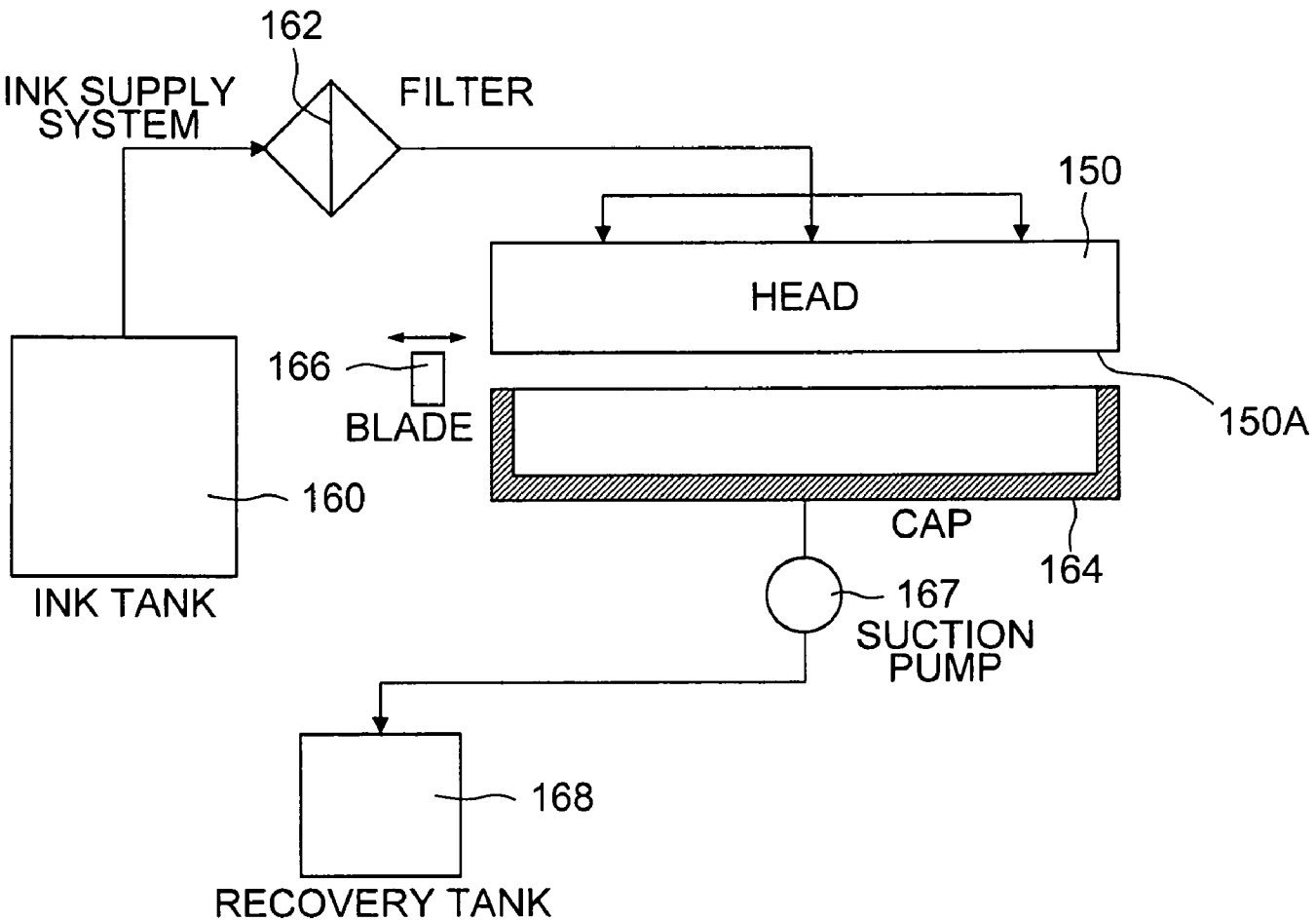
FIG. 5 is a compositional diagram showing the approximate composition of an ink supply system in an inkjet recording apparatus according to an embodiment of the present invention.

FIG. 5 is a schematic drawing showing the configuration of an ink supply system in the inkjet recording apparatus 110. The ink tank 160 is a base tank that supplies ink to the print head 150 and is set in the ink storing and loading unit 114 described with reference to FIG. 3. The embodiments of the ink tank 160 include a refillable type and a cartridge type: when the remaining amount of ink is low, the ink tank 160 of the refillable type is filled with ink through a filling port (not shown) and the ink tank 160 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 160 in FIG. 5 is equivalent to the ink storing and loading unit 114 in FIG. 3 described above.

A filter 162 for removing foreign matters and bubbles is disposed between the ink tank 160 and the head 150 as shown in FIG. 5. The filter mesh size in the filter 162 is preferably equivalent to or less than the diameter of the nozzle of the print head 150 and commonly about 20 μm.

Although not shown in the drawings, it is preferable to provide a sub-tank integrally to the print head 150 or nearby the print head 150. The sub-tank has a damper function for preventing variation in the internal pressure of the head and a function for improving refilling of the print head.

The inkjet recording apparatus 110 also includes: a cap 164 as a device to prevent the nozzles from drying out and to prevent an increase in the ink viscosity in the vicinity of the nozzles; and a cleaning blade 166 as a device to clean the nozzle face 150A.

A maintenance unit including the cap 164 and the cleaning blade 166 can be moved relatively with respect to the print head 150 by a movement mechanism (not shown), and is moved from a predetermined holding position to a maintenance position below the print head 150 as required.

The cap 164 is displaced up and down relatively with respect to the print head 150 by an elevator mechanism (not shown). When the power of the inkjet recording apparatus 110 is turned OFF or when the inkjet recording apparatus 110 is in a print standby state, the cap 164 is raised to a predetermined elevated position by the elevator mechanism so as to come into close contact with the print head 150, and the nozzle area of the nozzle face 150A is thereby covered with the cap 164.

The cleaning blade 166 is composed of rubber or another elastic member, and can slide on the ink ejection surface (nozzle surface 150A) of the print head 150 by means of a blade movement mechanism (not shown). When ink droplets or foreign matter has adhered to the nozzle surface 150A, the nozzle surface 150A is wiped and cleaned by sliding the cleaning blade 166 on the nozzle surface 150A.

During printing or standby, when the frequency of use of specific nozzles is reduced and ink viscosity increases in the vicinity of these nozzles, a preliminary discharge is made to eject the ink degraded due to the increase in viscosity toward the cap 164.

Furthermore, when the ink inside the print head 150 has increased in viscosity, the cap 164 is placed on the print head 150, ink which has increased in viscosity inside the pressure chamber 152 is removed by suction with a suction pump 167, and the ink removed by suction is sent to a recovery tank 168. This suction operation is also carried out in order to suction and remove degraded ink which has hardened due to increasing in viscosity when ink is loaded into the print head for the first time, and when the print head starts to be used after having been out of use for a long period of time.

In other words, when a state in which ink is not ejected from the print head 150 continues for a certain amount of time or longer, the ink solvent in the vicinity of the nozzles evaporates and the ink viscosity increases. In such a state, ink can no longer be ejected from the nozzles even if bubbles are generated by heat from the heat generating elements (heaters). Consequently, before a state of this kind arises, a "preliminary ejection" is carried out to eject ink in the vicinity of the nozzle which has an increased viscosity. Furthermore, after cleaning away soiling on the surface of the nozzle surface 150A by means of a wiper, such as a cleaning blade 166, provided as a cleaning device on the nozzle surface 150A, a preliminary ejection is also carried out in order to prevent infiltration of foreign matter into the nozzles due to the rubbing action of the wiper. The preliminary ejection is also referred to as "dummy ejection", "purge", "liquid ejection", and so on.

Furthermore, if the increase in the viscosity of the ink inside the nozzle exceeds a certain level, then it becomes impossible to eject ink by means of the preliminary ejection described above, and the suctioning operation described below needs to be carried out.

More specifically, if the ink viscosity inside a nozzle has increased to a certain level or above, then even if a bubble is created by means of the heat generating element, it is difficult to eject ink from the nozzle. In a case of this kind, suctioning is carried out by placing a cap 164 on the nozzle surface 150A of the print head 150 and suctioning the ink of increased viscosity by means of the pump 167. In this way, the head having an arrangement of the large nozzles and the small nozzles as shown in FIG. 1 is suctioned by means of the single cap 164.

However, this suction action is performed with respect to the ink inside all of the pressure chambers 152, and therefore the amount of ink consumption is considerable. In the present embodiment, by providing the small nozzle liquid chambers 17 and the large nozzle liquid chambers 18 before (in front of) the small nozzles 11 and the large nozzles 12, the ink suctioning volume of each large nozzle and the ink suctioning volume of each small nozzle can be balanced, and moreover, the ink consumption caused by the suctioning operation can be reduced. The cap 164 shown in FIG. 5 functions as a suctioning device and it may also function as an ink receptacle for the preliminary ejection.

Preferably, the inside of the cap 164 is divided by means of partitions into areas each of which corresponds to each nozzle row, thereby achieving a composition in which suction can be performed selectively for each of the demarcated areas, by means of selectors, or the like.

Figure 6:
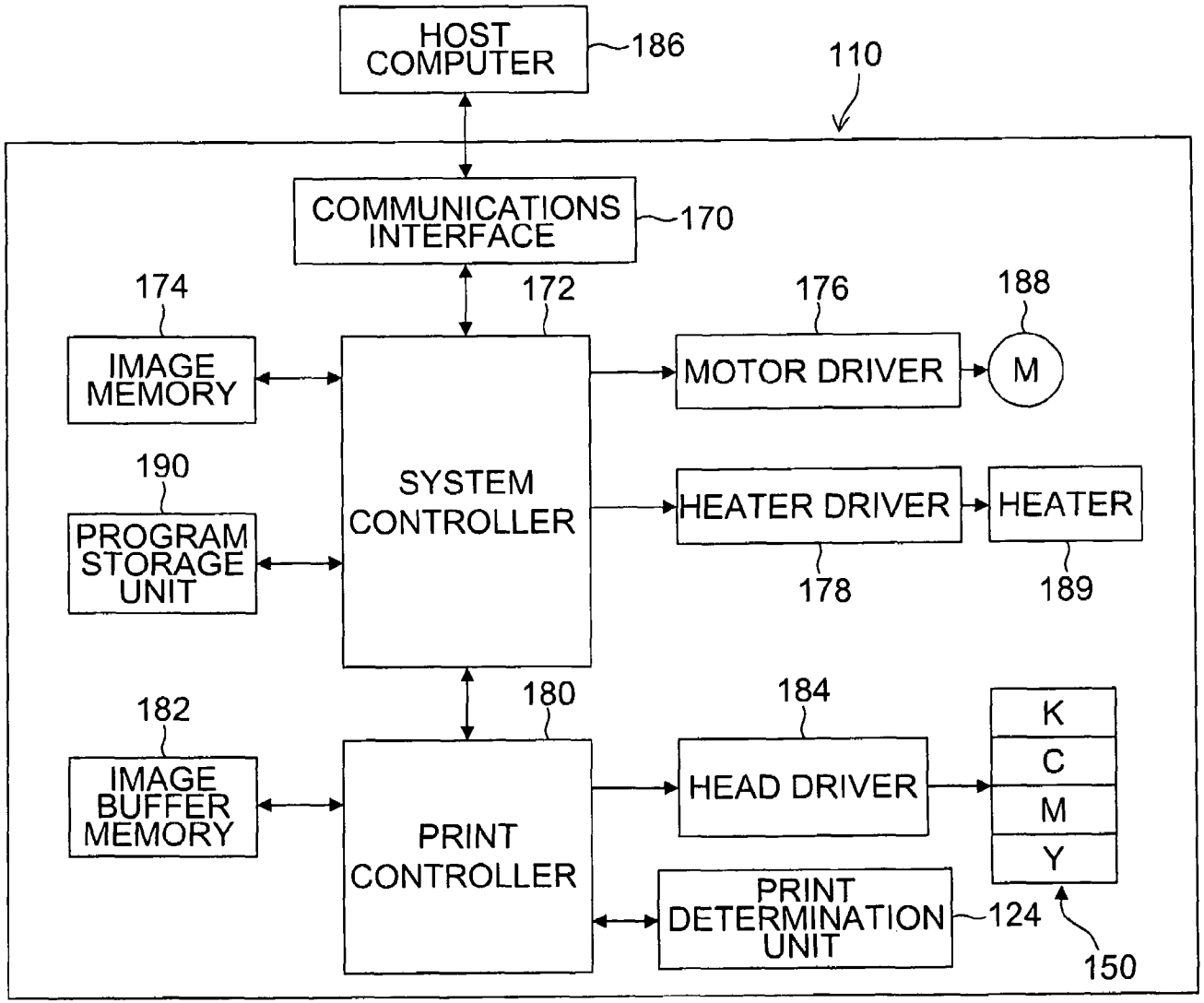
FIG. 6 is a principal block diagram showing the system configuration of an inkjet recording apparatus according to an embodiment of the present invention.

FIG. 6 is a principal block diagram showing the system configuration of the inkjet recording apparatus 110. The inkjet recording apparatus 110 comprises a communications interface 170, a system controller 172, a memory 174, a motor driver 176, a heater driver 178, a print controller 180, an image buffer memory 182, a head driver 184, and the like.

The communications interface 170 is an interface unit for receiving image data sent from a host computer 186. A serial interface such as USB (universal serial bus), IEEE1394, Ethernet (registered trademark) , wireless network, or a parallel interface such as a Centronics interface may be used as the communications interface 170. A buffer memory (not shown) may be mounted in this portion in order to increase the communication speed. The image data sent from the host computer 186 is received by the inkjet recording apparatus 110 through the communications interface 170, and is temporarily stored in the memory 174. The memory 174 is a storage device for temporarily storing images inputted through the communications interface 170, and data is written and read to and from the memory 174 through the system controller 172. The memory 174 is not limited to a memory composed of semiconductor elements, and a hard disk drive or another magnetic medium may be used.

The system controller 172 is a control unit for controlling the various sections, such as the communications interface 170, the memory 174, the motor driver 176, the heater driver 178, and the like. The system controller 172 is constituted by a central processing unit (CPU) and peripheral circuits thereof, and the like, and in addition to controlling communications with the host computer 186 and controlling reading and writing from and to the memory 174, and the like, it also generates control signals for controlling the motor 188 of the conveyance system and the heater 189.

The motor driver (drive circuit) 176 drives the motor 188 in accordance with commands from the system controller 172. The heater driver (drive circuit) 178 drives the heater 189 of the post-drying unit 142 (shown in FIG. 3), and the like, in accordance with commands from the system controller 172.

The print controller 180 has a signal processing function for performing various tasks, compensations, and other types of processing for generating print control signals from the image data stored in the memory 174 in accordance with commands from the system controller 172 so as to supply the generated print control signal to the head driver 184. Prescribed signal processing is carried out in the print controller 180, and the ejection amount and the ejection timing of the ink droplets from the print heads 150 are controlled (i.e., droplet ejection control is performed) via the head driver 184, on the basis of the print data. By this means, desired dot size and dot positions can be achieved.

The print controller 180 is provided with the image buffer memory 182, and image data, parameters, and other data are temporarily stored in the image buffer memory 182 when image data is processed in the print controller 180. The embodiment shown in the figure is one in which the image buffer memory 182 accompanies the print controller 180; however, the memory 174 may also serve as the image buffer memory 182. Also possible is an embodiment in which the print controller 180 and the system controller 172 are integrated to form a single processor.

The head driver 184 drives the piezoelectric elements of the heads of the respective colors 112K, 112C, 112M, and 112Y on the basis of print data supplied by the print controller 180. The head driver 184 can be provided with a feedback control system for maintaining constant drive conditions for the print heads.

Various control programs are stored in a program storage section 190, and the control programs are read out and executed in accordance with commands from the system controller 172. The program storage section 190 may use a semiconductor memory such as a ROM and EEPROM, a magnetic disk, and the like. And an external interface may be provided, and a memory card or PC card may also be used. Naturally, a plurality of these may also be provided. The program storage section 190 may also be combined with a storage device for storing operational parameters, and the like (not shown).

The print determination unit 124 is a block that includes the line sensor as described above with reference to FIG. 3, reads the image printed on the recording paper 116, determines the print conditions (presence of the ejection, variation in the dot formation, and the like) by performing required signal processing, or the like, and provides the print controller 180 with the determination results of the print conditions. According to requirements, the print controller 180 makes various corrections with respect to the head 150 on the basis of information obtained from the print determination unit 124.

The system controller 172 and the print controller 180 may be constituted by one processor, and it is also possible to use a device which combines a system controller 172, a motor driver 176, and a heater driver 178, in a single device, or a device which combines a print controller 180 and a head driver in a single device.

Next, the liquid ejection head according to a second embodiment of the present invention is described below with reference to FIGS. 7 and 8.

Figure 7:
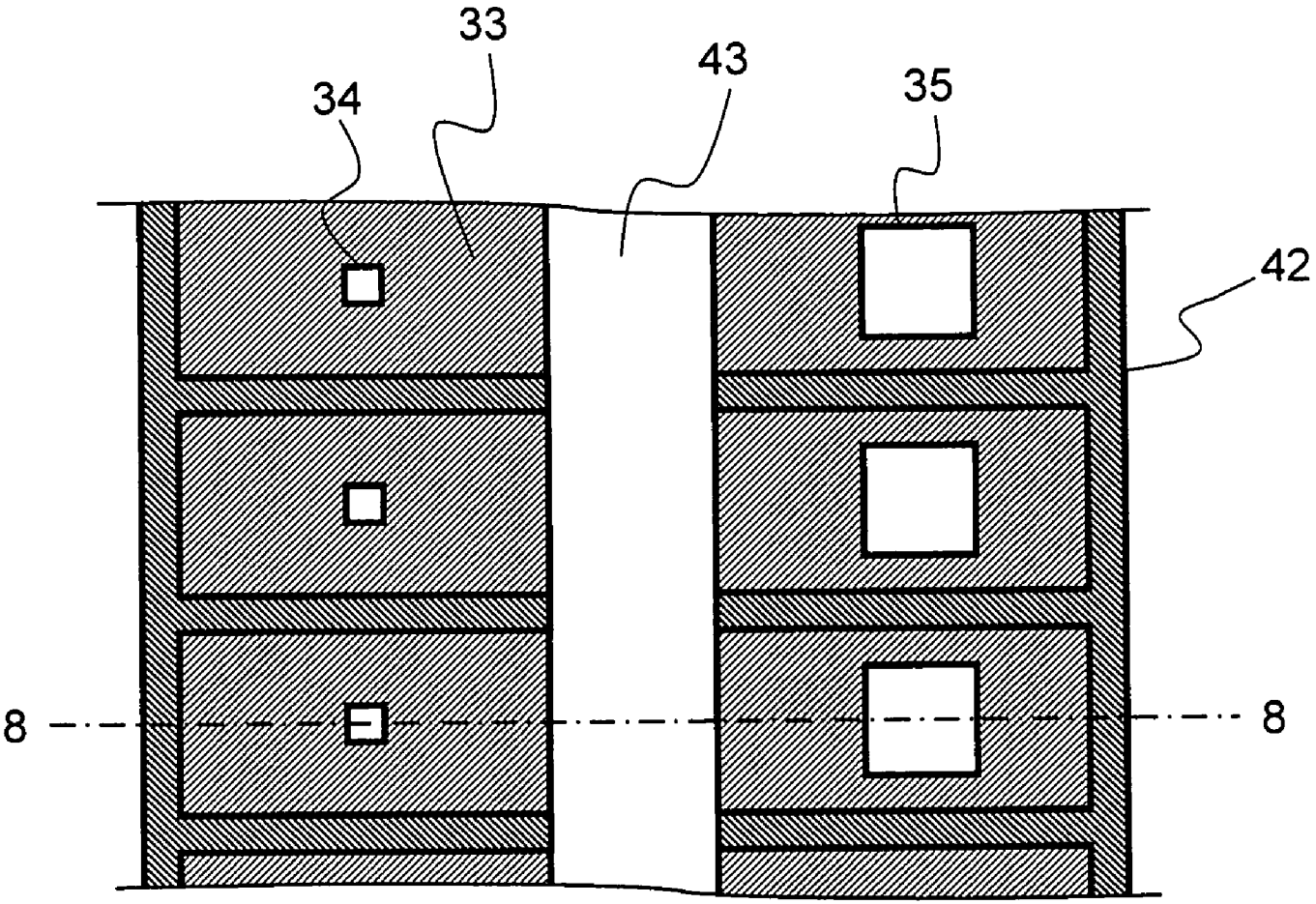
FIG. 7 is a plan perspective diagram of an arrangement of a liquid ejection head according to a second embodiment of the present invention, the nozzle plate being removed.

FIG. 7 is a plan perspective diagram showing a liquid ejection head according to the second embodiment of the present invention, in a state where the nozzle plate is removed. FIG. 8 is a cross-sectional diagram showing the liquid ejection head according to the second embodiment of the present invention, along line 8-8 in FIG. 7.

Figure 8:
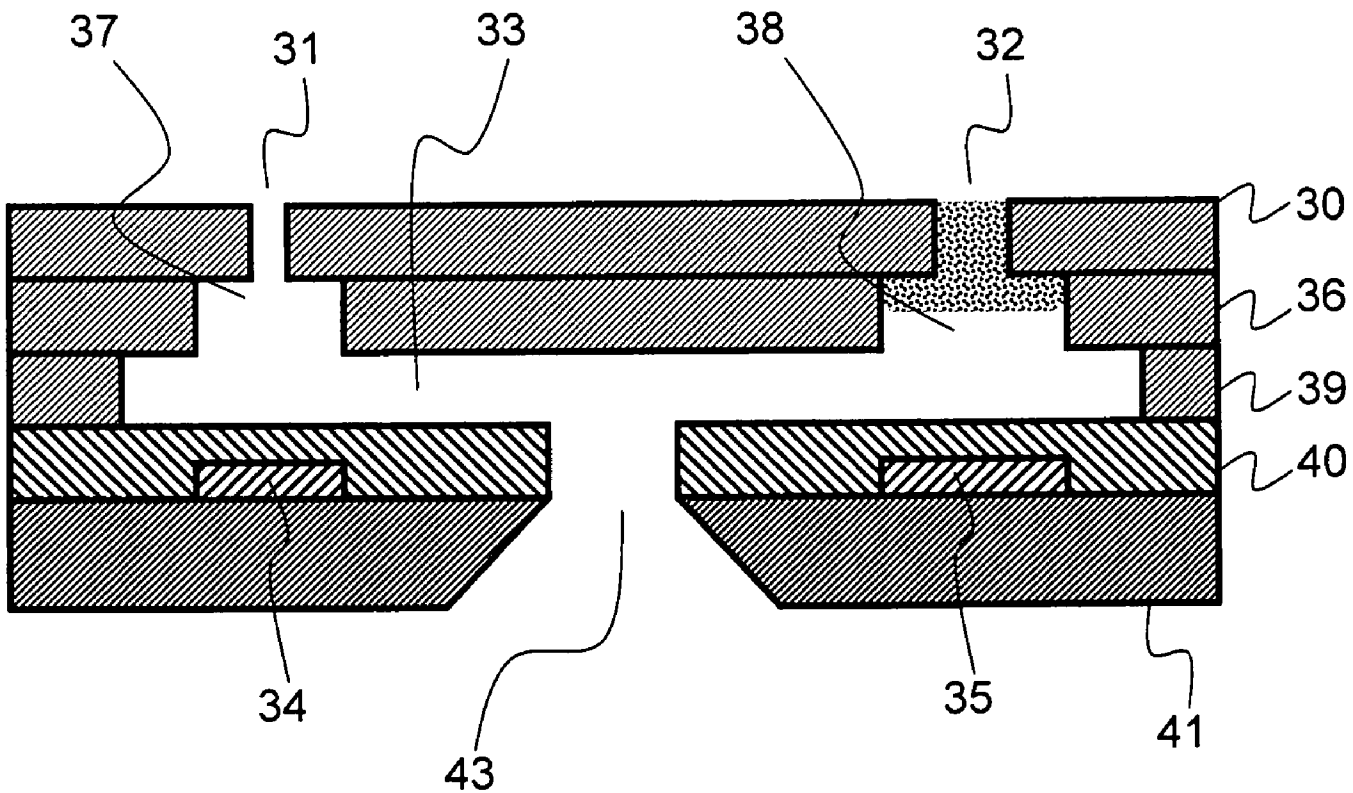
FIG. 8 is a cross-sectional diagram of the liquid ejection head according to the second embodiment of the present invention.

As shown in FIG. 8, in the liquid ejection head according to the second embodiment, nozzles (small nozzles) 31 for ejecting small liquid droplets and nozzles (large nozzles) 32 for ejecting large liquid droplets are disposed in the nozzle plate 30 in such a manner that each small nozzle 31 and the corresponding large nozzle 32 are arranged in a substantially symmetrical pattern. In terms of the horizontal direction in FIG. 8, a common flow channel 43 is located between the small nozzle 31 and the large nozzle 32. The ink flow channels include individual flow channels 33 and the common flow channel 43. A heater 34 corresponding to each small nozzle 31 and a heater 35 corresponding to each large nozzle 32 are provided on a substrate 41 so as to respectively oppose the nozzles 31 and 32 across the corresponding individual flow channels 33, which serves as a part of the ink flow channels. A protective layer 40 covers the heaters 34 and 35. A large nozzle liquid chamber 38, which serves as an ink chamber, is provided between each large nozzle 32 and the heater 35 corresponding to same, so as to be situated in a position adjacent to the corresponding individual flow channel 33. Similarly, a small nozzle liquid chamber 37, which serves as an ink chamber, is provided between each small nozzle 31 and the heater 34 corresponding to same, so as to be situated in a position adjacent to the corresponding individual flow channel 33. The large nozzle liquid chambers 38 and the small nozzle liquid chambers 37 are formed by providing holes, or the like, in the nozzle liquid chamber plate 36. Each large nozzle liquid chamber 38 has a greater volume than the volume of each small nozzle liquid chamber 37. The individual flow channels 33 are divided by the individual flow channel plate 39, and they are connected to the common flow channel 43 which serves as a part of the ink flow channels, whereby ink is supplied to each individual flow channel 33 from an ink tank (not illustrated). Furthermore, as shown in FIG. 7, the individual flow channels 33 are divided by the partition wall 42 formed by the individual flow channel plate 39, and furthermore the whole of the liquid ejection head is surrounded by the partition wall 42 of the individual flow channel plate 39. A heater 34 corresponding to one small nozzle 31 or a heater 35 corresponding to one large nozzle 32 is provided for each of the individual flow channels 33.

In the liquid ejection head according to the present embodiment of the present invention, ink is supplied from the common flow channel 43 to the individual flow channels 33. The ink supplied to the individual flow channels 33 is ejected from the small nozzles 31 and the large nozzles 32 on the basis of information from the control system of the image forming apparatus.

Since the frequency of use of the large nozzles 32 is low, increase in the viscosity of ink starts from the ink of the large nozzles 32. In the present embodiment, the large nozzle liquid chambers 38 are provided, and hence the increase in the viscosity of ink hardly extends into the individual flow channels 33 until the region of the increased viscosity ink expands all over the large nozzle liquid chambers 38.

Therefore, when a suctioning operation is carried out to remove the ink of increased viscosity, it is sufficient to suction the ink accumulated in the large nozzles 32 and the large nozzle liquid chambers 38, and suctioning of the ink inside the individual flow channels 33 is not necessary. Consequently, the consumption of ink in the suctioning operation is reduced in comparison with the related art.

Suctioning is carried out when the viscosity of ink has increased. Since the large nozzles 32 generally have a lower usage frequency as described above, then the viscosity of the ink in the large nozzles 32 is liable to increase to a greater extent than that of the ink in the small nozzles 31. Since the large nozzles 32 have a large nozzle diameter (and since the large nozzle liquid chambers 38 occupies a greater volume than the small nozzle liquid chambers 37), then the geometrical flow channel resistance of the large nozzles 32 is lower. In the large nozzles 32, the increase in the viscosity of the ink causes the ink flow resistance to rise, whereas the geometrical flow resistance is thus low. On the other hand, in the small nozzles 31, the increase of the ink flow resistance caused by increase in the viscosity of the ink is small, whereas the geometrical flow channel resistance is high. Consequently, in the suctioning operation, ink is not excessively suctioned from only either one of the nozzles 31 and 32, and the suctioning operation is carried out with respect to both the large nozzle 32 and the small nozzle 31 in a well balanced fashion. Moreover, since the increased viscosity ink of the large nozzles 32 is present inside the large nozzle liquid chambers 38, then the overall consumption of the ink due to the suctioning operation is reduced.

Figure 9:
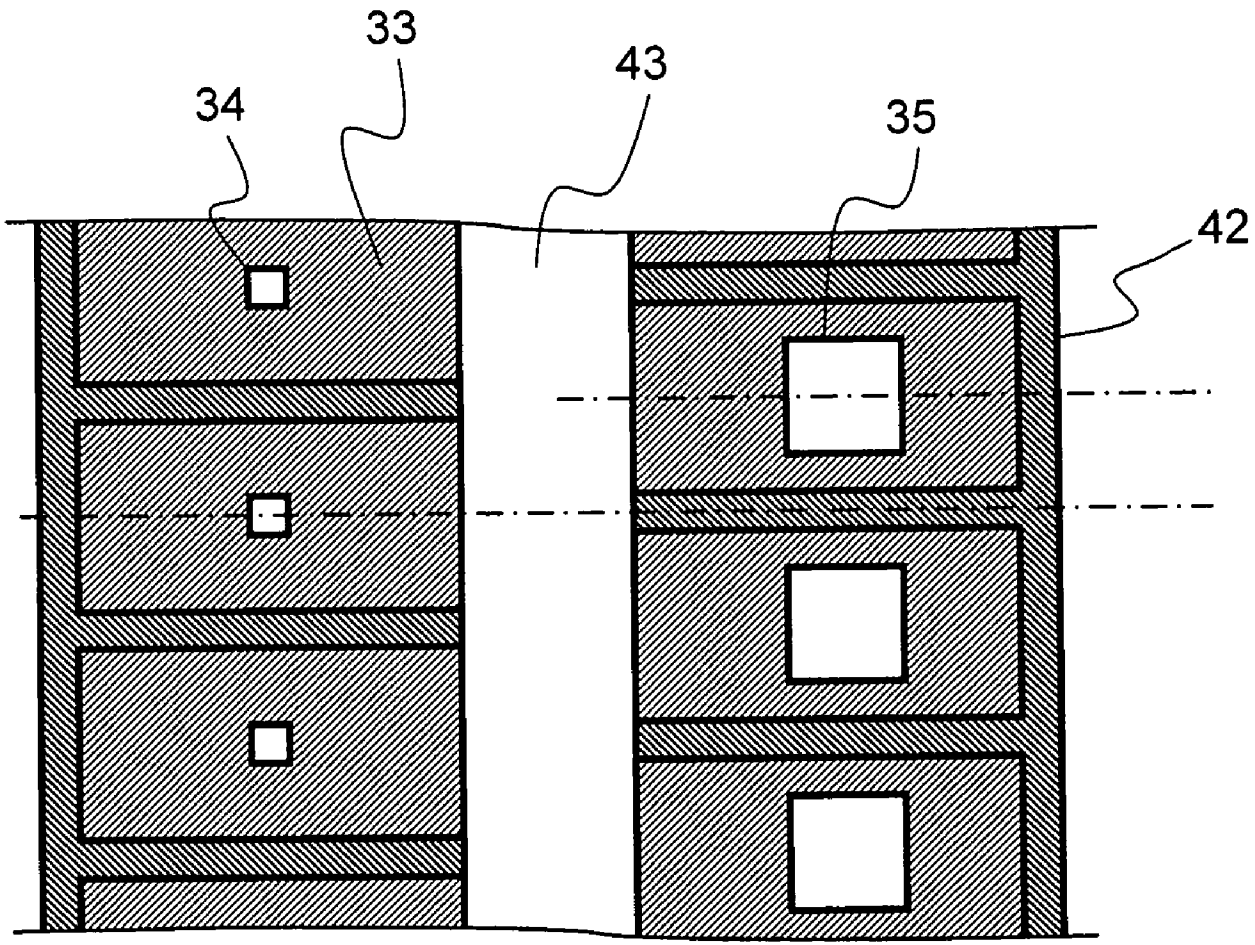
FIG. 9 is a plan perspective diagram of another arrangement of the liquid ejection head according to the second embodiment of the present invention, a nozzle plate being removed.

In FIG. 8, the small nozzles 31 and the large nozzles 32 are arranged in parallel with the scanning direction; however, depending on the control system, it is also possible to provide the heaters 34 corresponding to the small nozzles 31 and the heaters 35 corresponding to the large nozzles 32, for the individual flow channels 33 which is connected to the common flow channel 43 constituted by the partition wall 42, in such a manner that the small nozzles 31 and the large nozzles 32 are arranged in a staggered configuration, as shown in FIG. 9.

Next, the liquid ejection head according to a third embodiment of the present invention is described below with reference to FIG. 10.

Figure 10:
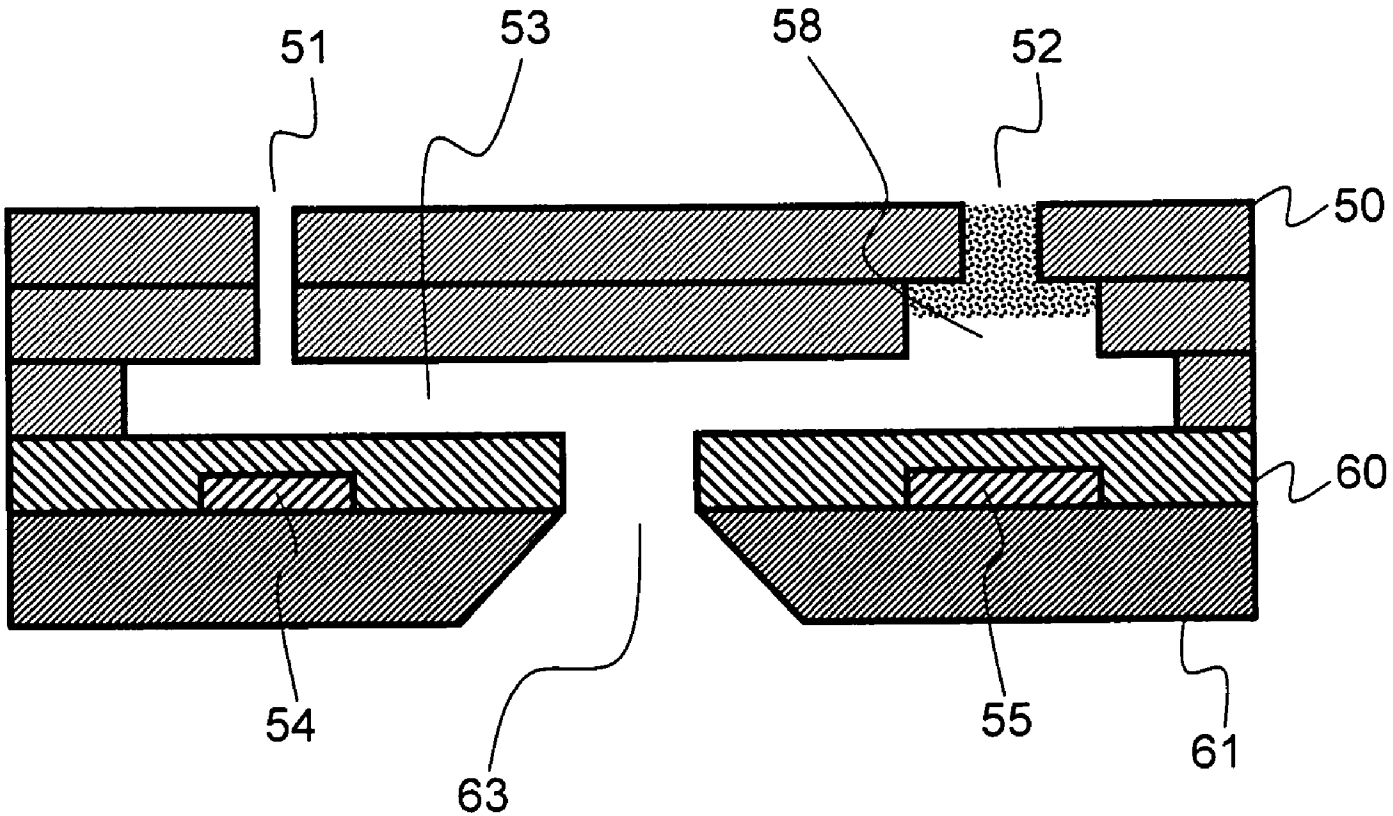
FIG. 10 is a cross-sectional diagram of a liquid ejection head according to a third embodiment of the present invention.
Figure 11:
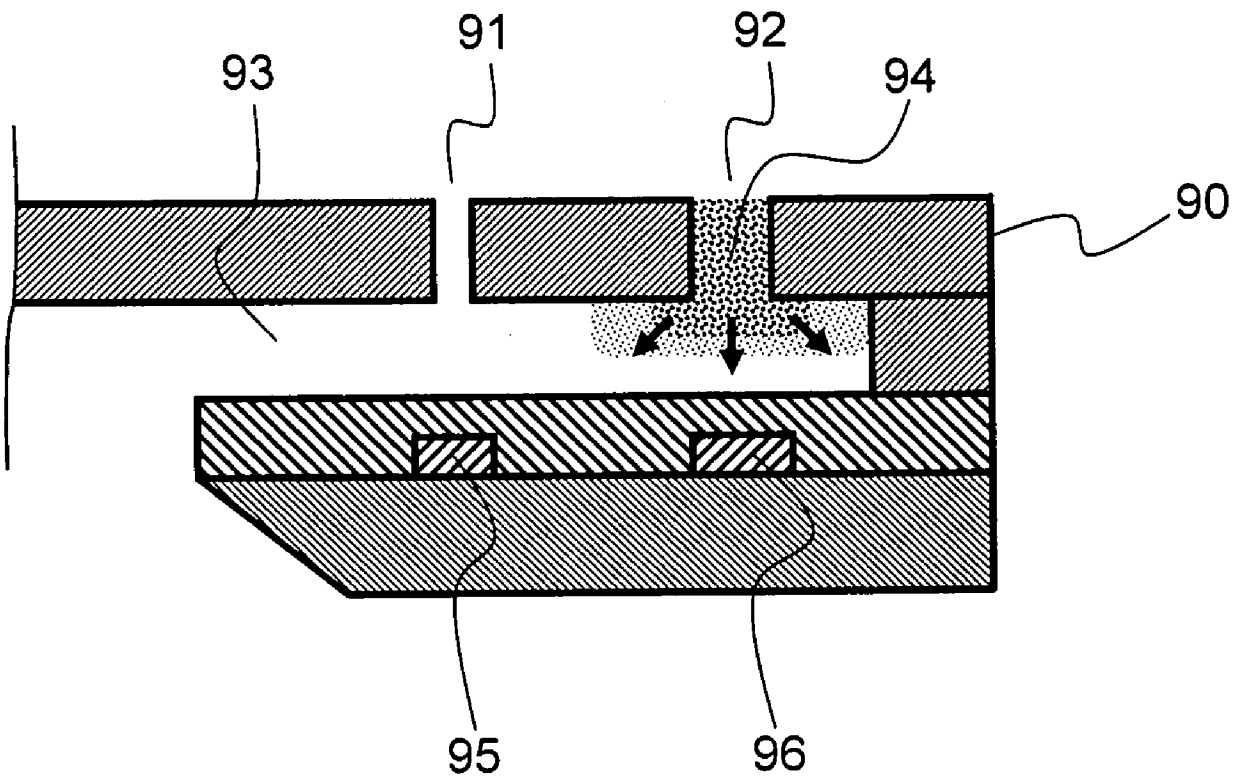
FIG. 11 is a cross-sectional diagram of a liquid ejection head in the related art.

FIG. 10 is a cross-sectional diagram showing a liquid ejection head according to the third embodiment of the present invention.

In the liquid ejection head according to the third embodiment, small nozzles 51 and large nozzles 52 are provided in a nozzle plate 50, as shown in FIG. 10. The ink flow channels include individual flow channels 53 and a common flow channel 63. A heater 54 corresponding to each small nozzle 51 and a heater 55 corresponding to each large nozzle 52 are provided on a substrate 61 so as to respectively oppose the nozzles 51 and 52 across the individual flow channels 53, which serve as a part of the ink flow channels. A protective layer 60 is formed on top of the heaters 54 and 55. A large nozzle liquid chamber 58, which serves as an ink chamber, is provided between each large nozzle 52 and the heater 55 corresponding to same, so as to be situated in a position adjacent to the individual flow channel 53. The individual flow channels 53 are connected to the common flow channel 63 which serves as a part of the ink flow channels, whereby ink is supplied to the individual flow channels 53 from an ink tank (not illustrated).

In the liquid ejection head according to the present embodiment, ink is supplied from the common flow channel 63 to the individual flow channels 53. The ink supplied to the individual flow channels 53 is ejected from the small nozzles 51 and the large nozzles 52 on the basis of information from the control system of the image forming apparatus.

Since the usage frequency of the large nozzles 52 is low, then increase in the viscosity of the ink starts from ink of the large nozzles 52. In the present embodiment, the large nozzle liquid chambers 58 are provided, and hence the increase in the viscosity of the ink does not start to extend into the individual flow channels 53 until the region of the increased viscosity ink has expanded all over the large nozzle liquid chambers 58.

Therefore, when a suctioning operation is carried out to remove the ink of increased viscosity, it is sufficient to suction the ink accumulated in the large nozzles 52 and the large nozzle liquid chambers 58, and suctioning of the ink inside the individual flow channels 53 is not necessary. Consequently, the consumption of ink in the suctioning operation is reduced in comparison with the related art.

Suctioning is carried out when the viscosity of the ink has increased. Since the large nozzles 52 generally have a lower frequency of use as described above, then the viscosity of the ink in the large nozzles 52 is liable to increase to a greater extent than that of the ink in the small nozzles 51. Since the large nozzles 52 have a broad nozzle diameter and the large nozzle chambers 58 are provided, then the geometrical flow channel resistance of the large nozzles 52 is lower. Thus, in the large nozzles 52, the increase in the viscosity of the ink causes the ink flow resistance to rise, whereas the geometrical flow resistance is low. On the other hand, in the small nozzles 51, the increase of the ink flow resistance caused by increase in the ink viscosity is small, whereas the geometrical flow channel resistance is high. Consequently, in the suctioning operation, ink is not suctioned excessively from only either one of the nozzles 51 and 52, and the suctioning operation is carried out with respect to both of the large nozzle 52 and the small nozzle 51 in a well balanced fashion. As a result, the amount of ink consumption by the suctioning operation can be reduced.

Liquid ejection heads according to the present invention are described in detail above, but the present invention is not limited to the aforementioned embodiments, and it is possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a large nozzle which ejects a large droplet of liquid;

a small nozzle which has a smaller nozzle diameter than the large nozzle and ejects a small droplet of the liquid which has a smaller volume than the large droplet;

at least one individual flow channel which supplies the liquid from a common flow channel to the large nozzle and the small nozzle;

a first heat generating element and a second heat generating element which are provided opposite to the large nozzle and the small nozzle respectively, and apply thermal energy to the liquid in the at least one individual flow channel so as to generate a bubble causing the large droplet of the liquid to be ejected from the large nozzle and a bubble causing the small droplet of the liquid to be ejected from the small nozzle respectively; and a first liquid chamber which is provided between the large nozzle and the first heat generating element corresponding to the large nozzle, the first liquid chamber facing the first heat generating element across the at least one individual flow channel.

2. The liquid ejection head as defined in claim 1, further comprising a second liquid chamber which is provided between the small nozzle and the second heat generating element corresponding to the small nozzle.

3. The liquid ejection head as defined in claim 1, wherein the large nozzle and the small nozzle are provided for each of the at least one individual flow channel.

4. The liquid ejection head as defined in claim 3, wherein the small nozzle is nearer to the common flow channel than the large nozzle.

5. An image forming apparatus comprising the liquid ejection head as defined in claim 1.

* * * * *